US006629912B2

(12) United States Patent
Downs

(10) Patent No.: US 6,629,912 B2
(45) Date of Patent: Oct. 7, 2003

(54) CORE MUSCLES RESISTANCE EXERCISER

(76) Inventor: Ed Downs, 16592 NW. 2nd La., Pembroke Pines, FL (US) 33028

( * ) Notice: Subject to any disclaimer, the term of this patent is extended or adjusted under 35 U.S.C. 154(b) by 87 days.

(21) Appl. No.: 10/081,060

(22) Filed: Feb. 21, 2002

(65) Prior Publication Data

US 2003/0158022 A1 Aug. 21, 2003

(51) Int. Cl.[7] ..... A63B 21/02
(52) U.S. Cl. ..... 482/124
(58) Field of Search ..... D24/662, 684, D24/692; 482/124, 105, 121, 126, 103, 91, 125, 139

(56) References Cited

U.S. PATENT DOCUMENTS

| | | | | | |
|---|---|---|---|---|---|
| 866,495 | A | | 9/1907 | Marks | |
| 4,245,840 | A | * | 1/1981 | Van Housen | 482/126 |
| 5,176,377 | A | * | 1/1993 | Wilkinson | 482/120 |
| 5,318,494 | A | | 6/1994 | Santiguian | |
| 5,792,034 | A | * | 8/1998 | Kozlovsky | 482/124 |
| 5,860,944 | A | * | 1/1999 | Hoffman, Jr. | 602/19 |
| 6,517,470 | B1 | * | 2/2003 | Chak et al. | 482/126 |

* cited by examiner

*Primary Examiner*—Jerome W. Donnelly
(74) *Attorney, Agent, or Firm*—Ruben Alcoba

(57) ABSTRACT

A resistance exerciser aimed at working the core muscles of a human body. The exerciser comprises of a first and a second tubular force band, each force band having an upper and a lower end; a junction piece that has a first and a second groove defined within, wherein the grooves cross at the center of the junction piece in an x-pattern, thereby defining an x-junction, and wherein one of the grooves is ingrained deeper within the body of the junction piece than the other groove, and where the first force band is placed within the first groove and the second force band is placed within the second groove, thereby allowing the first and second bands to cross, minimizing the contact between the bands; an adjustable waist belt that attaches to the junction piece; a first and a second thigh sleeve, wherein the first thigh sleeve attaches to the lower end of the first force band forming a first connection point, and the second thigh sleeve attaches to the lower end of the second force band forming a second connection point; and a first and a second hand loop, wherein the first hand loop attaches to the upper end of the first force band, and the second hand loop attaches to the upper end of the second force band. The adjustable belt holds the x-junction in a central position with relation to the users body.

13 Claims, 4 Drawing Sheets

CORE MUSCLES RESISTANCE EXERCISER

BACKGROUND

Athletes and non-athletes today are in a constant search of finding a better way of targeting specific muscle groups in an efficient manner. One could easily spend thousands of dollars buying state of the art machines that would eventually target all of the muscles that comprise the core of the body, the core of the body being the center for all limb and trunk movements. Devices that target the core muscles enhance resistance to injuries while improving the user's balance, coordination, agility, and speed.

Portable resistance devices are known in the art, but none have specifically targeted the inner most regions of the body, more specifically, the core muscles of the body. The core muscles of the body being defined as follows: the abdominal muscles (transverse abdomens, rectus abdomens, internal oblique, and external oblique), hip flexor, gluteus muscle groups, and thoracic cavity musculature.

No prior art is known to the Applicant having the structure herein described or its mode of application.

Information relevant to attempts to address these problems can be found in U.S. Pat. Nos. 5,318,494, 866,495, and 4,245,840. However, each one of theses references suffers from the following disadvantage: an unequal distribution of force when applying force to the exercisers, causing the loss of an individual's center of gravity when using the exercisers, thereby forcing the user of the devices to use muscle groups not intended to be targeted.

For the foregoing reason there is a need of a core muscle resistance exerciser that targets the core muscles while minimizing the loss of the user's center of gravity, thereby maximizing the effectiveness of the exerciser.

SUMMARY

The present invention is directed to a resistance exerciser aimed at working the core muscles of a human body in a balanced manner. The exerciser comprises of a first and a second tubular force band, each force band having an upper and a lower end; a junction piece that has a first and a second groove defined within, wherein the grooves cross at the center of the junction piece in an x-pattern, thereby defining an x-junction, and wherein one of the grooves is ingrained deeper within the body of the junction piece than the other groove, and where the first force band is placed within the first groove and the second force band is placed within the second groove, thereby allowing the first and second bands to cross, minimizing the contact between the bands; an adjustable waist belt that attaches to the junction piece; a first and a second thigh sleeve, wherein the first thigh sleeve attaches to the lower end of the first force band forming a first connection point, and the second thigh sleeve attaches to the lower end of the second force band forming a second connection point; and a first and a second hand loop, wherein the first hand loop attaches to the upper end of the first force band, and the second hand loop attaches to the upper end of the second force band. The adjustable belt holds the x-junction in a central position with relation to the user's body so that when a user uses this invention, all of the ends of the x-junction will be aligned with one of the user's limbs.

The x-junction forces the user to exert an equal amount of force to counteract the force that is applied to exercise system, this is done in a manner that promotes balance, e.g., when force is applied to the exercise system by lifting a hand from a shoulder position upward, two things might occur, the first thing that might occur is that the user will raise the leg that is attached to the force band connecting the arm raised, thereby equally distributing the pulling force and the pushing force so that equilibrium will be attained between the forces. The second event that might occur is that the user will exert an equal amount of force away from the force created by raising the arm so that the same amount of energy expended by raising the arm upward will have to be expended to maintain the leg downward, thereby turning the exerciser from an aerobic device to an anaerobic device that will work the arms and the legs simultaneously. The movements made with this invention may be alternated between each arm and leg or they may be done simultaneously, depending whether the aim of the exercise is aerobic or anaerobic exercise. This invention allows the user to use consistent resistive forces throughout the exercise being attempted.

This exerciser is based on the opposing force principle, which occurs at the x-junction of the exerciser. The opposing force principle will be better understood by the following example: when the right hand of a user is raised, the left leg of the user will either be raised or an equal force will have to be applied to the leg to maintain an equilibrium between the forces being applied to the system. Note, the resistance created by an elastic component is proportional to the distance that it is stretched multiplied by a constant that reflects the physical characteristics of the elastic component. This means that the further you stretch the elastic component, the greater the amount of force on the system. When using this invention, all of the exercises use the opposing force principle, thereby forcing the user to exert a greater amount of force as the tubular force bands are stretched, thereby causing the user's muscles to work harder when their range of motion is near the end. This is a key aspect of this invention, for human muscle's capacity to do work is greater at the beginning of their range of motion and drop of considerably toward their end of motion. This invention forces human muscle's to work throughout their range of motion.

DRAWINGS

These and other features, aspects, and advantages of the present invention will become better understood with regard to the following description, appended claims, and accompanying drawings where:

DESCRIPTION

Figure 1:
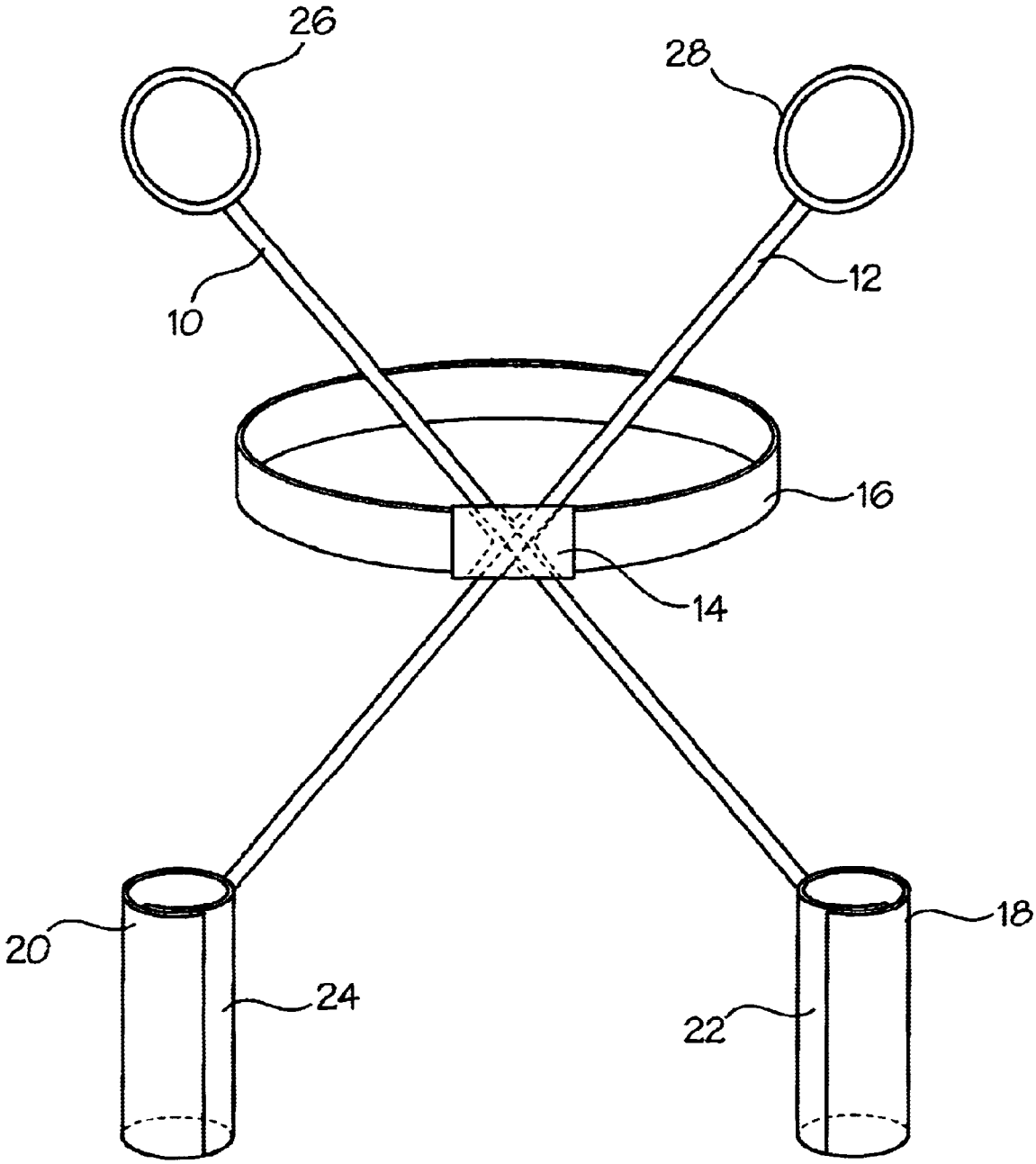
FIG. 1 shows a version one version of this invention.

As shown in FIG. 1, a core muscle resistance exerciser comprises 1. A core muscles resistance exerciser comprising a first 10 and a second 12 tubular force band, each force band having upper and lower ends; a junction piece 14 that has a first 14*a* and a second 14*b* groove defined within, wherein the grooves cross at the center of the junction piece in an x-pattern thereby defining an x-junction, and wherein one of the grooves is ingrained deeper within the body of the junction piece than the other groove, and where the first force band 10 is placed within the first groove 14*a* and the second force band 12 is placed within the second groove 14*b*, thereby allowing the first and second bands to cross, minimizing the contact between the bands; an adjustable waist belt 16 that attaches to the junction piece 14; a first 18 and a second 20 thigh sleeve, wherein the first thigh sleeve 18 attaches to the lower end of the first force band 10 forming a first connection point 22, and the second thigh sleeve 20 attaches to the lower end of the second force band 12 forming a second connection point 24; and a first 26 and a second 28 hand loop, wherein the first hand loop attaches to the upper end of the first force band, and the second hand loop attaches to the upper end of the second force band. The core muscle resistance exerciser is used to perform aerobic and anaerobic exercises.

Referring to FIG. 1, the inventor utilizes natural latex rubber tubing for the tubular force bands 10, 12, although other materials such as synthetic rubbers, plastics or even springs could be used. The inventor currently uses three different resistance levels for the tubular for bands 10, 12 by utilizing tubing of three different wall thickness, i.e. 1/16", 3/32", 1/8" thick, for low, medium, and high resistance, respectively. The inventor color-codes the tubular force bands 10,12 to inform the user of the resistance level being utilized. All of the elements are attached by means that are known in the art, e.g. hooks, adhesives, straps, rings, and combinations thereof The tubular force bands are inserted from one end of the opened groove opening to the other end of the openings prior to attaching all of the elements together, for the grooves are constructed so that tubular force bands will not pop out of the x-junction when exercising. This construction can be simply made by boring through the junction piece two openings that cross each other, with one opening overlapping the other. The securing mechanism for the belt could be one of the many known securing devices, including Velcro or a buckle.

Figure 2:
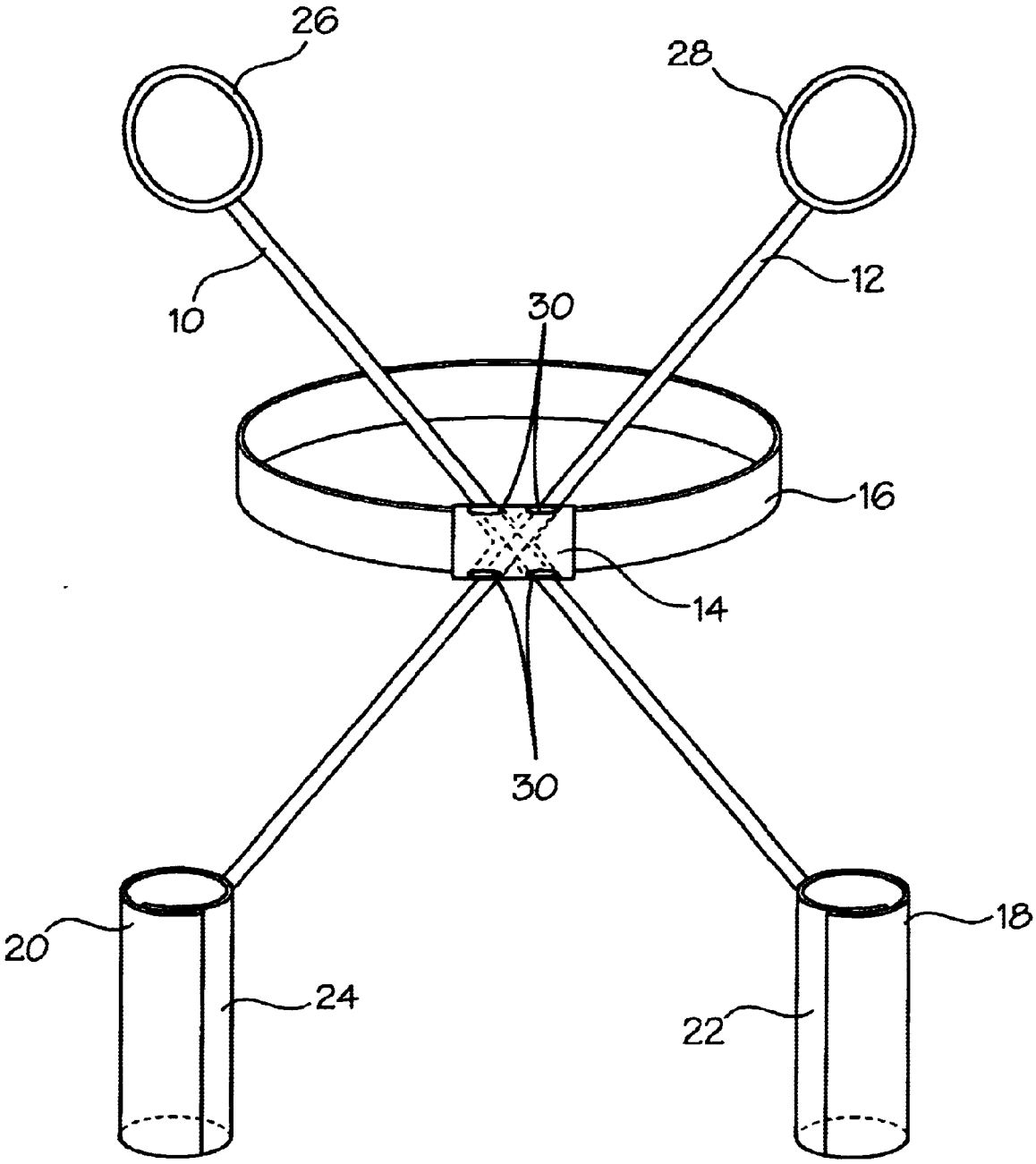
FIG. 2 shows another version of this invention.

Another embodiment of the invention is shown in FIG. 2, this embodiment adds a pulley system 30 to the above invention. The pulley system 30 comprises of placing a pulley 30 at each end of the grooves of the junction piece 14. The pulleys will be attached to the junction piece by means known in the art. The pulley system 30 facilitates the passage of the tubular force bands 10, 12 trough the x-junction.

Figure 3:
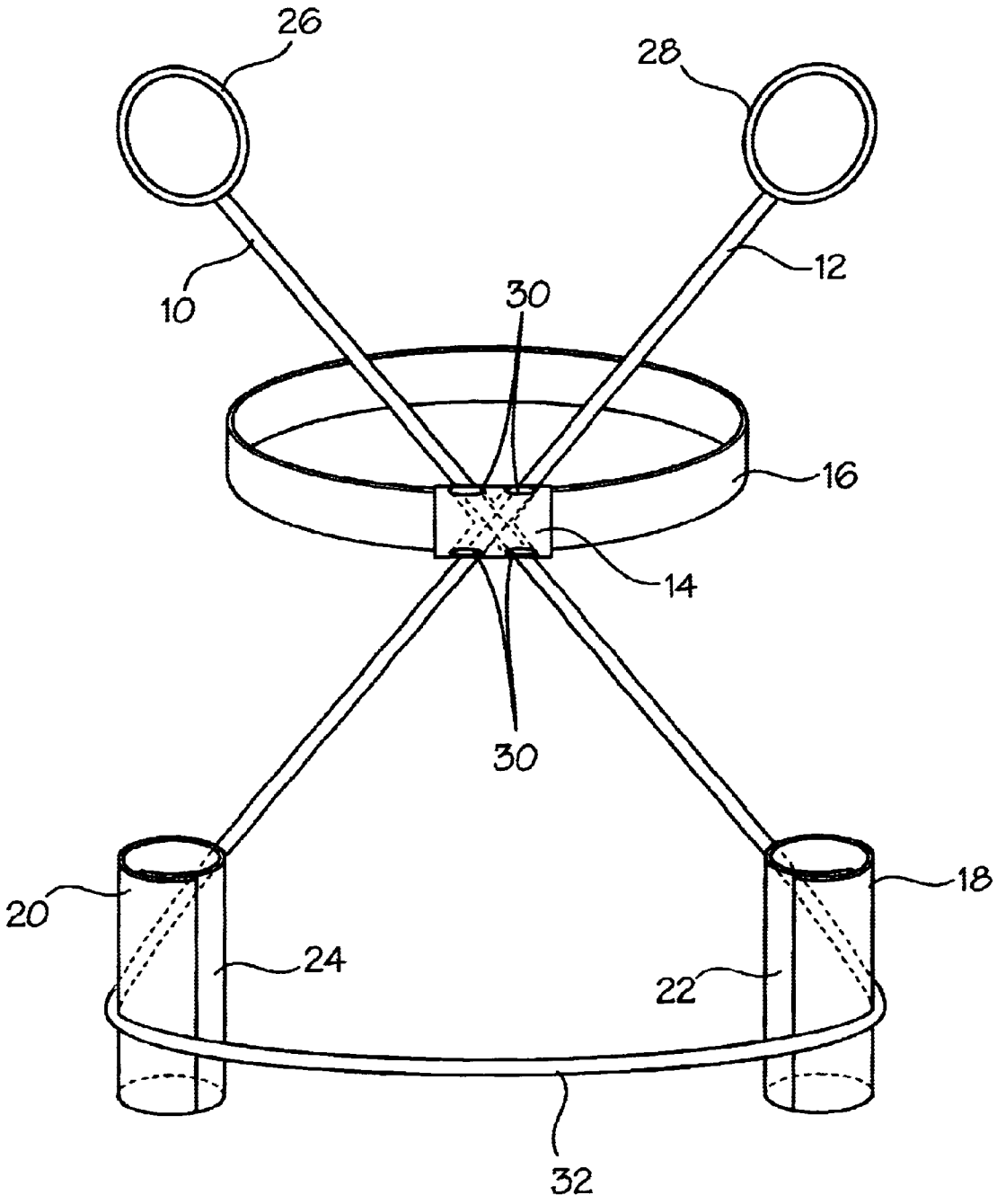
FIG. 3 shows a third version of this invention.

Yet another embodiment of the invention is shown in FIG. 3, this embodiment further comprises an adductor resistance force band 32 having a first and a second end, wherein the first end of the adductor resistance force band would attach to the first connection point 22, and the second end of the adductor resistance force band would attach to the second connection point 24, and wherein the adductor resistance force band 32 would be fixedly attached to the first 18 and second thigh 20 sleeves in a manner that encircles each thigh sleeve so that when force is applied to the user's thighs, the force would be distributed evenly to each thigh, and wherein at least 4 inches of the adductor resistance force band 32 will not be attached to either the first 18 or as second 20 thigh sleeve. The adductor resistance for band 32 is meant to be used by users that have a higher level of fitness that the previous two embodiments, for the addition of this band will require the user to exert more energy when performing exercises that involve the lower part of the body.

Figure 4:
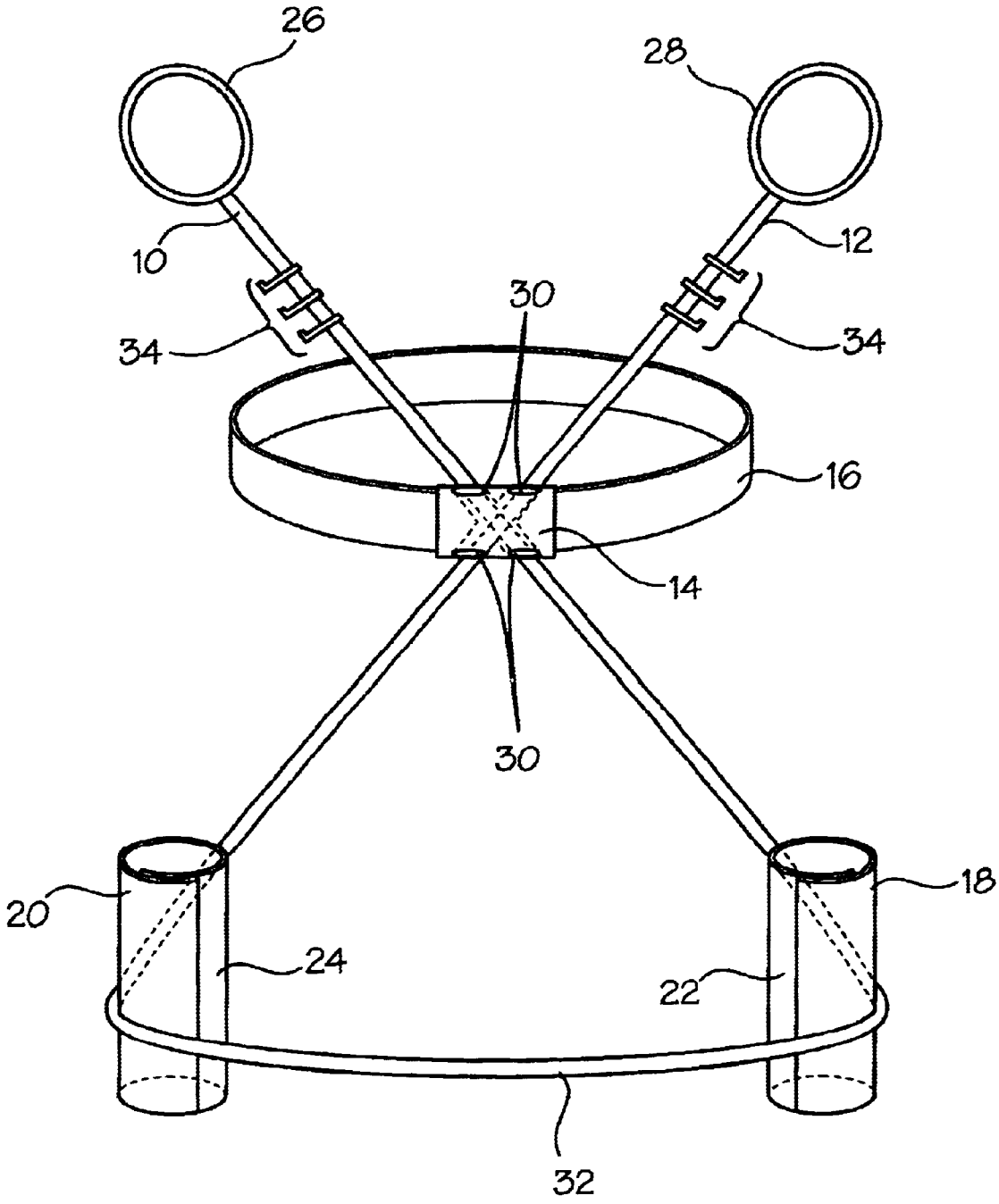
FIG. 4 shows another version of this invention.

Another embodiment of the present invention is shown in FIG. 4, This embodiment further comprises at least one clip 34 to be attached to the upper ends of the tubular force bands 10, 12. The clips 34 are used to adjust the length of the tubular force bands 10, 12 by securing the hand loops 26, 28 to the clip 34 that will provide the user with the best fit for a starting resistance for the users size.

The following will depict some of the exercises that can be performed using the core muscle resistance exerciser:

Supine Squat Away

1. Standing in a beginning squat position with hands by shoulders.
2. Perform a squat while engaging the hands either upward or in a forward direction from the starting position.

Stepping to the side and into the squat position while at the same time engaging the arms as described above can perform an alternative variation of the above exercise.

Supine Squat Away Starting With a Step Bench

1. Standing in a beginning squat position with one foot on a bench, while the user has one his hands by his shoulders, the user would perform a squat while engaging the arms as described above.
2. The user would then return to the start position and then alternate the opposite foot on the bench and repeat the exercise above mentioned.

Side Kick and Punch

1. Take one leg out in an abduction raise while engaging the arm that counteracts the force created by the abduction raise, then come back to the starting position.
2. Step out into a lunge with opposite leg than the leg used to perform the abduction raise and engage the same arm.
3. Repeat the above exercise alternating from one leg to another in sequence.

The previously described versions of the present invention have many advantages including the targeting of the core muscles of the body while minimizing the loss of the user's center of gravity, thereby maximizing the effectiveness of the exerciser. This advantage in turn will enhance the user's resistance to injury, while at the same time improving the user's balance, coordination, agility and speed.

Although the present invention has been described in considerable detail with reference to certain preferred versions thereof, other versions are possible. Therefore, the spirit and scope of the claims should not be limited to the description of the preferred versions contained herein.

I claim:

1. A core muscles resistance exerciser comprising:

first and second tubular force bands, each force band having upper and lower ends;

a junction piece that has a first and a second groove defined within, wherein the grooves cross at the center of the junction piece in an x-pattern thereby defining an x-junction, and wherein one of the grooves is ingrained deeper within the body of the junction piece than the other groove, and where the first force band is placed within the first groove and the second force band is placed within the second groove, thereby allowing the first and second bands to cross, minimizing the contact between the bands;

an adjustable waist belt that attaches to the junction piece;

a first and a second thigh sleeve, wherein the first thigh sleeve attaches to the lower end of the first force band forming a first connection point, and the second thigh sleeve attaches to the lower end of the second force band forming a second connection point; and a first and a second hand loop, wherein the first hand loop attaches to the upper end of the first force band, and the second hand loop attaches to the upper end of the second force band.

2. The exerciser of claim 1, further comprising a pulley system, wherein the pulley system comprises of a pulley being attached at each end of the grooves so that when force is applied in any direction of the x-junction of the exerciser, the pulleys will facilitate the passage of the bands through the x-junction.

3. The exerciser of claim 2, wherein the tubular force bands can be of variable resistance, the resistance would be dependant on the diameter size of the tubular force bands.

4. The exerciser of claim 3, further comprising an adductor resistance force band having a first and a second end, wherein the first end of the adductor resistance force band would attach to the first connection point, and the second end of the adductor resistance force band would attach to the second connection point, and wherein the adductor resistance force band would be fixedly attached to the first and second thigh sleeves in a manner that encircles each thigh sleeve so that when force is applied to the user's thighs, the force would be distributed evenly to each thigh, and wherein at least 4 inches of the adductor resistance force band will not be attached to either the first or second thigh sleeve.

5. The exerciser of claim 4, wherein each upper end of the tubular force bands has at least one clip so that the hand loops may be secured to the clips, thereby adjusting the length of the force bands.

6. The exerciser of claim 1, further comprising an adductor resistance force band having a first and a second end, wherein the first end of the adductor resistance force band would attach to the first connection point, and the second end of the adductor resistance force band would attach to the second connection point, and wherein the adductor resistance force band would be fixedly attached to the first and second thigh sleeves in a manner that encircles each thigh sleeve so that when force is applied to the user's thighs, the force would be distributed evenly to each thigh, and wherein at least 4 inches of the adductor resistance force band will not be attached to either the first or second thigh sleeve.

7. The exerciser of claim 6, further comprising a pulley system, wherein the pulley system comprises of a pulley being attached at each end of the grooves so that when force is applied in any direction of the x-junction of the exerciser, the pulleys will facilitate the passage of the bands through the x-junction.

8. The exerciser of claim 7, wherein each upper end of the tubular force bands has at least one clip so that the hand loops may be secured to the clips, thereby adjusting the length of the force bands.

9. The exerciser of claim 8, wherein the tubular force bands can be of variable resistance, the resistance would be dependant on the diameter size of the tubular force bands.

10. The exerciser of claim 1, wherein each upper end of the tubular force bands has at least one clip so that the hand loops may be secured to the clips, thereby adjusting the length of the force bands.

11. The exerciser of claim 10, further comprising a pulley system, wherein the pulley system comprises of a pulley being attached at each end of the grooves so that when force is applied in any direction of the x-junction of the exerciser, the pulleys will facilitate the passage of the bands through the x-junction.

12. The exerciser of claim 11, further comprising an adductor resistance force band having a first and a second end, wherein the first end of the adductor resistance force band would attach to the first connection point, and the second end of the adductor resistance force band would attach to the second connection point, and wherein the adductor resistance force band would be fixedly attached to the first and second thigh sleeves in a manner that encircles each thigh sleeve so that when force is applied to the user's thighs, the force would be distributed evenly to each thigh, and wherein at least 4 inches of the adductor resistance force band will not be attached to either the first or second thigh sleeve.

13. The exerciser of claim 12, wherein the tubular force bands can be of variable resistance, the resistance would be dependant on the diameter size of the tubular force bands.

* * * * *